US007430769B2

(12) United States Patent
Davis

(10) Patent No.: US 7,430,769 B2
(45) Date of Patent: Oct. 7, 2008

(54) ADJUSTABLE BATHTUB FOR CHILDREN

(75) Inventor: Dennis L. Davis, Springfield, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 465 days.

(21) Appl. No.: 11/026,716

(22) Filed: Dec. 30, 2004

(65) Prior Publication Data

US 2006/0143819 A1 Jul. 6, 2006

(51) Int. Cl.
*A47K 3/024* (2006.01)

(52) U.S. Cl. ..... 4/572.1; 4/578.1

(58) Field of Classification Search ..... 4/572.1, 4/578.1, 546, 548, 554, 538, 584, 586
See application file for complete search history.

(56) References Cited

U.S. PATENT DOCUMENTS

| | | | |
|---|---|---|---|
| 4,561,135 | A | 12/1985 | Adriaansen |
| 4,974,267 | A | 12/1990 | Sheu |
| 5,033,131 | A | 7/1991 | Paden |
| 5,092,001 | A | 3/1992 | Ross et al. |
| 5,181,284 | A | 1/1993 | Raphael et al. |
| 5,361,430 | A | 11/1994 | Wise |
| 5,425,149 | A | 6/1995 | Crossley et al. |
| 5,809,588 | A | 9/1998 | Angelotti |
| 5,926,866 | A | 7/1999 | Chao |
| 5,966,752 | A | 10/1999 | Abugideiri |
| 6,018,826 | A | 2/2000 | Yang |
| 6,112,343 | A | 9/2000 | Dixon |
| 6,212,706 | B1 | 4/2001 | Rossman et al. |
| 6,256,803 | B1 | 7/2001 | Sauerbrei et al. |
| RE37,481 | E | 12/2001 | Crossley et al. |
| 6,415,460 | B1 | 7/2002 | Rossman et al. |
| 6,507,959 | B1 | 1/2003 | Sundberg et al. |
| 6,578,209 | B2 | 6/2003 | Lopes et al. |

FOREIGN PATENT DOCUMENTS

GB 165933 * 6/1921

* cited by examiner

*Primary Examiner*—Huyen Le
(74) *Attorney, Agent, or Firm*—Taft Stettinius & Hollister LLP

(57) ABSTRACT

A multi-piece bathtub for children comprising at least two bathtub segments adapted to be assembled to provide one of a plurality of predetermined fluid retaining areas, where a first of the bathtub segments is operative to cooperate with a second of the bathtub segments to at least partially define one of the plurality of predetermined fluid retaining areas operative to resist fluid leakage by providing a sealed fluidic interface between the first and second bathtub segments.

20 Claims, 3 Drawing Sheets

ADJUSTABLE BATHTUB FOR CHILDREN

BACKGROUND

1. Field of the Invention

The present invention is directed to children's bathing areas and, more specifically, to an adjustable bathtub for bathing a child that is adaptable to the changing dimensions of a growing child.

2. Background of the Invention

Bathing systems for children are well known in the art. Among such bathing systems are inflatable bathtubs, as well as fully collapsible bathtubs relying on a preexisting full size bathtub for support. Such collapsible bathtubs are operative to restrict the area of the full size bathtub commensurate with the relative size of the child.

SUMMARY OF THE INVENTION

The present invention is directed to children's bathing areas and, more specifically, to reconfigurable children's bathing areas comprised of two or more components that cooperate to define a bathing area. The invention generally includes two or more complimentary sections adapted to be mounted to one another to define a sealed fluid holding area. More generally, the invention utilizes the concept that multiple complementary components can hold a larger volume of fluid than the sum of the individual fluid holding volumes of the components.

The invention also makes available the opportunity to reconfigure the children's bathing area not only for disassembly and storage, but also to increase the bathing area as the child grows. To accomplish this reconfigurable functionality, one of the bathtub components includes a sealing surface that is adapted to interface with one of a plurality of complimentary sealing surfaces of a second bathtub component. For example, the first bathtub component may include a groove having a gasket seated therein, while a second bathtub component includes a plurality of spaced apart ribs. In such an exemplary embodiment, the ribs are laterally spaced so that by changing which rib interfaces with the gasket, the length (and resulting volume) of the bathing area may be changed.

DETAILED DESCRIPTION

The exemplary embodiments of the present invention are described and illustrated below to encompass bathing areas for children. Of course, it will be apparent to those of ordinary skill in the art that the embodiment discussed below is exemplary in nature and may be reconfigured without departing from the scope of the present invention. However, for clarity and precision, the exemplary embodiment as discussed below may include optional steps, methods, apparatuses, and/or features that one of ordinary skill should recognize as not being a requisite to fall within the scope of the present invention.

Figure 1:
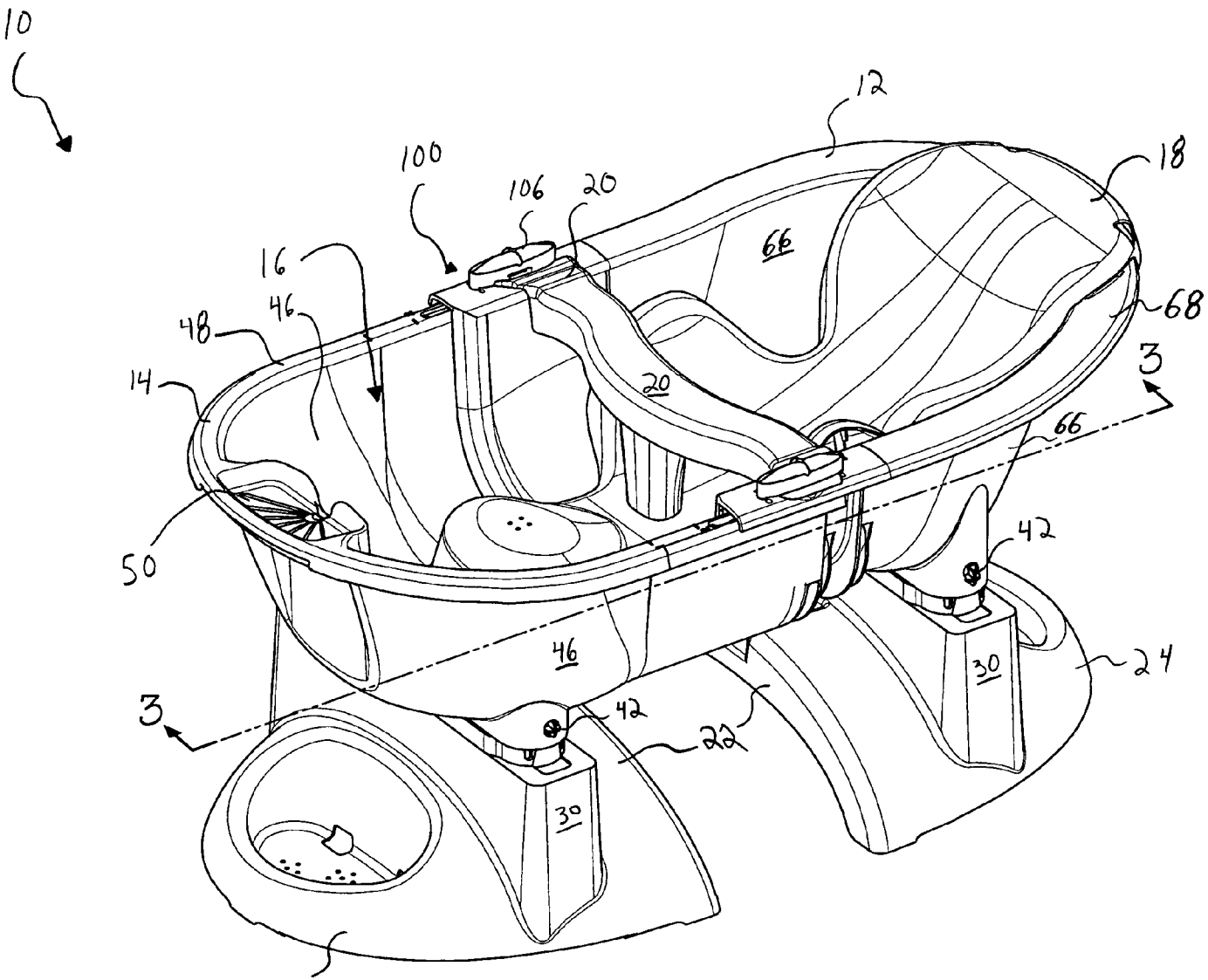
FIG. 1 is an elevated perspective view of an exemplary embodiment of the present invention.

Referencing FIG. 1, an exemplary assembled bathtub 10 in accordance with the present invention includes a first bathtub section 12 and a second bathtub section 14 providing a fluid holding area 16. The fluid holding area 16 may include a cradle insert 18 and a cross member 20 each adapted to provide support for a child seated or partially lying in the bathtub 10. A base 22 is optionally mounted to the sections 12, 14 to support and elevate the bathtub 10.

Figure 2:
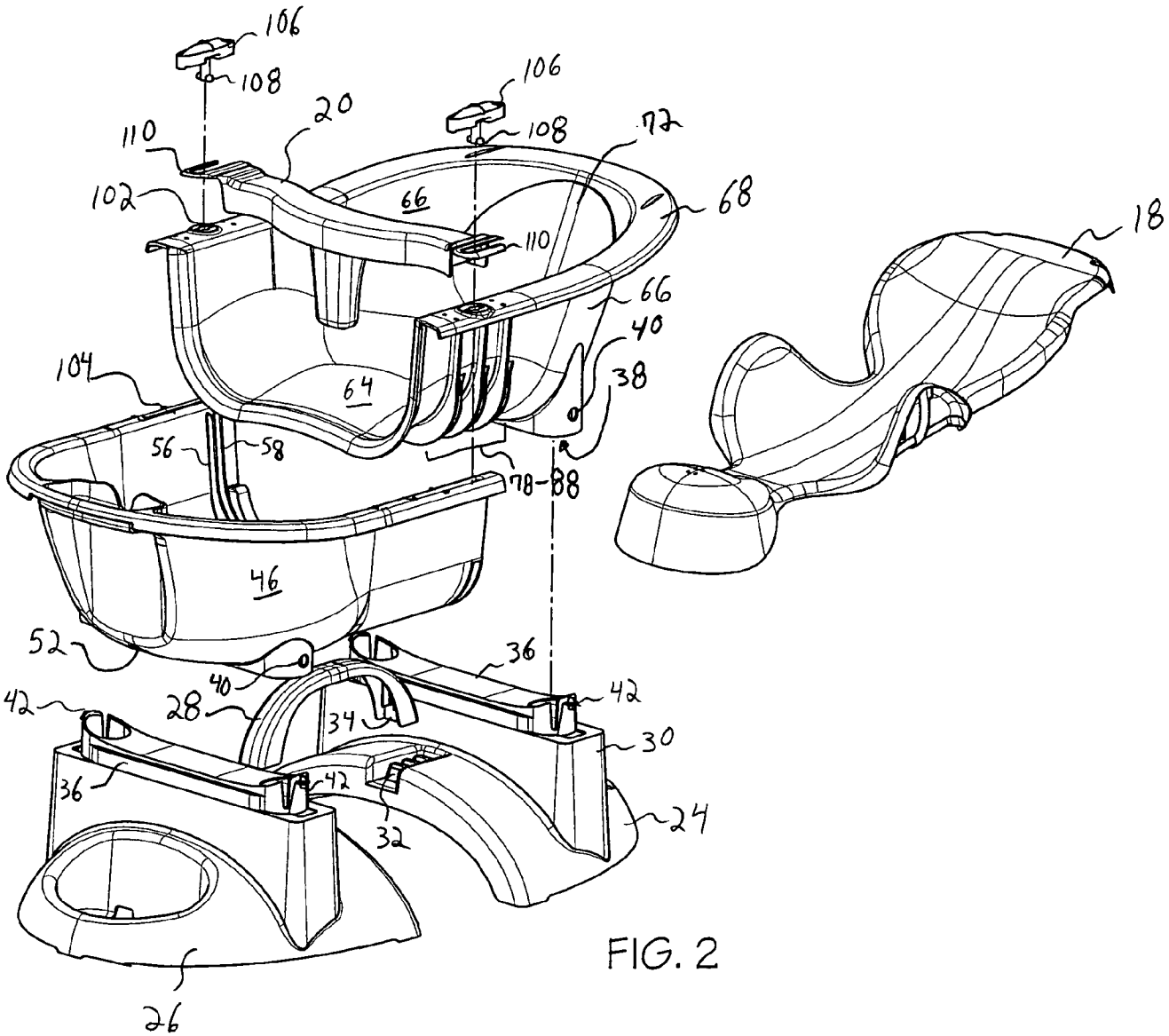
FIG. 2 is an exploded view of the exemplary embodiment of FIG. 1.

As shown in FIGS. 1 and 2, the base 22 includes a right side stand 24, a left side stand 26 and a lateral support 28. Each stand 24, 26 includes a raised tower 30 adjacent to a series of projections 32. The projections 32 are laterally spaced apart and adapted to be received by a recess 34 of the lateral support 28 to effectively restrict lateral movement between the stands 24, 26 and thus mount the stands 24, 26 together. Each raised tower 30 includes a raised plateau 36 adapted to be received by a cavity 38 associated with each section 12, 14. Each cavity 38 includes a pair of holes 40 adapted to receive a corresponding detent 42 of the plateau 36, subsequent to the cavity 38 receiving the plateau 36, in order to mount each section 12, 14 to its corresponding stand 24, 26.

Figure 3:
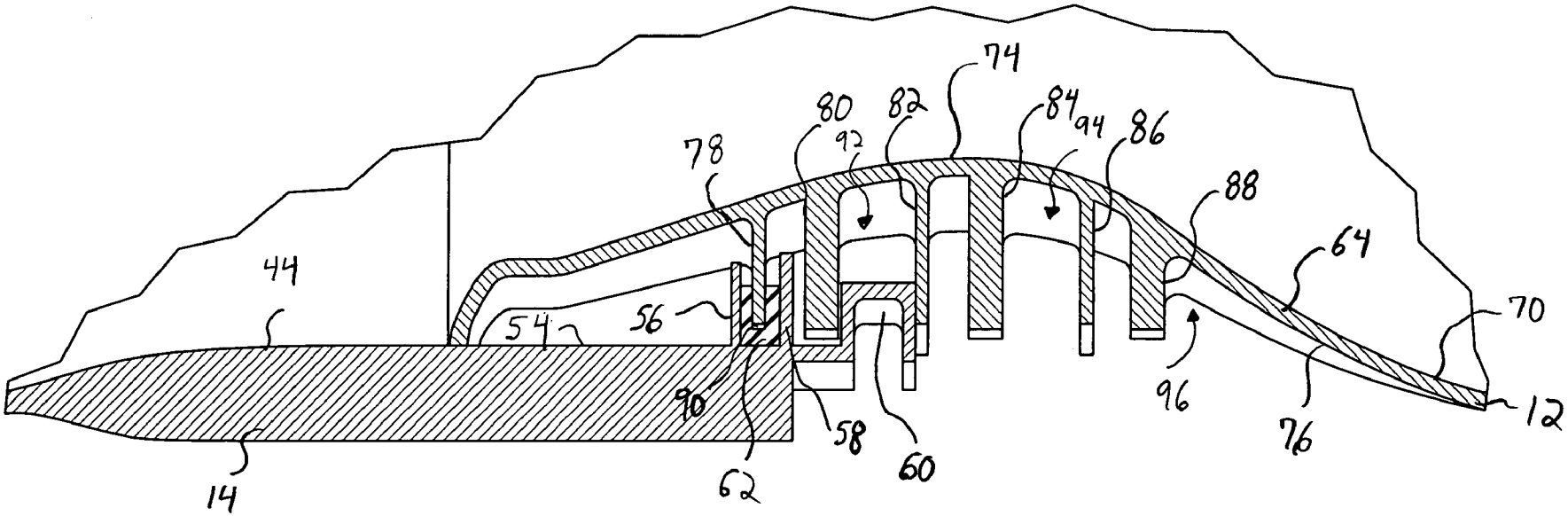
FIG. 3 is a segmented cross-sectional view of the exemplary embodiment of FIG. 1, taken along lines 3-3.

Referring to FIGS. 1-3, the second bathtub section 14 is substantially open at one end and includes a floor 44 transitioning into a raised sidewall 46 that includes a flange 48. The flange 48 and sidewall 46 of the second bathtub section 14 cooperate to provide a depression 50 adapted for use as a soap receptacle. The floor also includes a drain 52 operative to selectively expel fluid from the holding area 16. An interior surface 54 of the floor 44 and sidewall 46 includes two parallel raised ribs 56, 58 adjacent to a spacer 60. A gasket 62 is positioned to interpose the raised ribs 56, 58 and, as will be discussed below, is utilized to provide a fluidic seal between the bathtub sections 12, 14.

The first bathtub section 12 is substantially open at one end and includes a floor 64 transitioning into a sidewall 66 that includes a flange 68. The floor 64 may be contoured to accommodate the bottom features of a child, which might include a depression 70 interposing a rear pad 72 and a hump 74. An underneath surface 76 of the floor 66 and sidewall 62 includes a series of parallel ribs 78-88. The underside of the hump 68 provides a concavity that at least partially protects the ribs 78-88, however, it is not required that the ribs be protected by a concave topography or other protective feature.

Referencing FIGS. 2 and 3, to assemble the bathtub 10, the tub sections 12, 14 are oriented to overlap so that one of the ribs 78, 82, 86 on the underside 76 of the first tub section 12 is vertically aligned to fit between the raised ribs 56, 58 of the second tub section 14. Compression of the tub sections 12, 14 toward one another is operative to wedge one of the ribs 78, 82, 86 within a groove 90 of the gasket 62. The interface between the gasket 62 and the rib 78, 82, 86, while the rib is wedged within the groove 90, is operative to provide a fluidic seal between the two tub sections 12, 14 that subsists across the floor and along the raised walls.

Concurrent with the alignment of the rib 78, 82, 86 and gasket 62, the spacer 60 is compression mounted within one of three gaps 92, 94, 96 on the underside 76 of the floor. The interaction between the spacer 60 and walls defining each gap 92, 94, 96 is operative to provide greater stability between the sections 12, 14 in the lengthwise direction when subjected to longitudinal forces attempting to increase or decrease the length of the bathtub 10 while the sections 12, 14 are mounted to one another.

The length of the bathtub 10 may be adjusted by vertically displacing the first section 12 from the second section 14 and aligning different corresponding features. For example, to provide a shorter length bathtub 10, the rib 86 would be aligned and received within the groove 90 of the gasket 62, while the spacer would occupy the gap 96. In contrast, to provide a longer length bathtub 10, the rib 82 would be aligned and received within the groove 90 of the gasket 62, while the spacer 60 would interpose adjacent ribs 84, 86 and occupy the gap 94. In sum, the exemplary embodiment provides three length modifications, however, it is within the scope of the invention that two or more modifications could be accommodated, such as by including additional ribs on the underside of the first bathtub section 12. Those of ordinary skill will readily understand how to modify the exemplary bathtub 10 to fabricate these obvious alternatives.

Referring to FIGS. 1 and 2, the alignment between corresponding features of the bathtub sections 12, 14 is maintained by a fastener assembly 100. The fastener assembly 100 includes an opening 102 through the flange 68 of the first tub section 12 that is adapted to be aligned with an opening 104 through the flange 48 of the second tub section 14 upon alignment the corresponding features of the sections 12, 14. Each T-shaped handle 106 is adapted to pierce both openings 102, 104 and be rotated to compress the sections 12, 14 toward one another in the radial direction and effectively mount the sections together. A set of projections 108 protrude out from each handle 106 and cooperate with an incline and recess (not shown) on the underside of the circumferential flange 48 of the second bathtub section 14 to compress the sections together upon rotation of the handles. The compressive forces resulting from the rotation of the handles 106 are operative to retain the relative orientation of the sections 12, 14 with respect to one another. More specifically, the compressive forces are operative to maintain the rib 78, 82, 86 within the groove 90 of the gasket 62 and provide a fluidic seal between the respective sections.

The fastener assembly 100 may also be operative to mount the cross member 20 to the first bathtub section 12. U-shaped ends 110 of the cross member 20 are adapted to accommodate the handles 106 so that rotation of the handles 106 to facilitate compression of the sections 12, 14 is also operative to compress and mount the cross member 20 between the handle 106 and first bathtub section 12. It is also within the scope of the invention that the sections 12, 14 be compressed by an action other than actuation of the handles 106.

To disassemble or reconfigure the bathtub 10, the handles 106 are simply rotated to decrease the compressive forces between the bathtub sections 12, 14. Thereafter, the first bathtub section 12 is vertically repositioned to disengage the second bathtub section 14. If the user simply desires to reconfigure the fluid holding area 16, the first bathtub section 12 is laterally repositioned and vertically lowered so that the corresponding features of the sections 12, 14 will interact upon compression to provide a sealed fluidic interface operative to hold a fluid body. This process may be repeated as desired until the desired bathing area is achieved.

It is also within the scope of the invention to provide a first bathtub section that includes a plurality of sealing surfaces incrementally spaced, and a second bathtub section that includes one or more corresponding sealing surfaces adapted to engage at least one of the sealing surfaces of the first bathtub section to provide a sealed fluidic interface between the bathtub sections and enable holding of a fluid body.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to the exemplary embodiment without departing from the scope of the invention as defined by the claims. Additionally, it is to be understood that the invention is defined by the claims and it is not intended that any limitations or elements describing the exemplary embodiment set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A multi-piece bathtub for children comprising:

at least two bathtub segments adapted to be assembled to provide at least two different predetermined fluid retaining areas having different volumes, wherein said bathtub segments are operative to cooperate to at least partially define a first one of the plurality of predetermined fluid retaining areas and to at least partially define a second one of the predetermined fluid retaining areas, the predetermined fluid retaining areas operative to resist fluid leakage by providing a sealed fluidic interface between the first and second bathtub segments and a coupler operative to connect said first and second bathtub segments in a sealed fluidic interface;

wherein one of said bathtub segments includes an interior surface including a floor and side walls, the interior surface having at least one groove, and another of the bathtub segments includes an exterior surface, the exterior surface having at least two parallel raised ribs to be engaged with the at least one groove.

2. The multi-piece bathtub of claim 1, further comprising:

a compressor operative to compress the first and second bathtub segments together.

3. The multi-piece bathtub of claim 2, wherein the compressor provides a resultant force in a radial direction of the first and second bathtub segments.

4. The multi-piece bathtub of claim 2, wherein the coupler and the compressor are integrated into a repositionable handle.

5. The multi-piece bathtub of claim 4, wherein:

each of the two bathtub segments includes a flange transitioning from the side walls partially defining an interior region;

at least a portion of the flange of the first bathtub segment is adapted to be overlapped by a portion of the flange of the second bathtub segment upon assembly;

the portions of each flange of the first and second bathtub segments includes an opening therethrough; and the handle is adapted to occupy at least a portion of the opening such that at least one of vertical repositioning and rotational repositioning of the handle is operative to provide a radial compressive force between the two bathtub segments and facilitate the sealed fluidic interface therebetween.

6. A multi-piece bathtub for children comprising:

at least two bathtub segments adapted to be assembled to provide at least two different predetermined fluid retaining areas having different volumes, wherein said bathtub segments are operative to cooperate to at least partially define a first one of the plurality of predetermined fluid retaining areas and to at least partially define a second one of the predetermined fluid retaining areas, the predetermined fluid retaining areas operative to resist fluid leakage by providing a sealed fluidic interface between the first and second bathtub segments and a repositionable T-shaped center support adapted to be mounted to at least one of the two bathtub segments and operative to span at least one of the two bathtub segments;

wherein one of said bathtub segments includes an interior surface including a floor and side walls, the interior surface having at least one groove, and the other of the bathtub segments includes an exterior surface, the exterior surface having at least two parallel raised ribs to be engaged with the at least one groove.

7. A multi-piece bathtub for children comprising:

at least two bathtub segments adapted to be assembled to provide a first one of a plurality of predetermined fluid retaining areas, where a first of the bathtub segments is operative to cooperate with a second of the bathtub segments to at least partially define the first one of the plurality of predetermined fluid retaining areas operative to resist fluid leakage by providing a sealed fluidic interface between the first and second bathtub segments;

wherein the first bathtub segment includes a receiving trench, and the second bathtub segment includes a first rib adapted to be received within the receiving wench to facilitate the sealed fluidic interface between the bathtub segments;

wherein the second bathtub segment includes a second rib adapted to be received within the trench, the first bathtub segment and the second bathtub segment at least partially defining a second of the plurality of predetermined fluid retaining areas when the second rib is received within the trench.

8. The multi-piece bathtub of claim 7, wherein the second bathtub segment includes a third rib adapted to be received within the receiving trench to facilitate the sealed fluidic interface between the bathtub segments.

9. The multi-piece bathtub of claim 8, further comprising a gasket interposing the receiving trench and at least one of the ribs to facilitate the sealed fluidic interface between the bathtub segments.

10. The multi-piece bathtub of claim 7, wherein the first bathtub segment further comprises a plurality of receiving trenches.

11. The multi-piece bathtub of claim 7, further comprising a gasket interposing at least one of the ribs and the receiving trench to facilitate the sealed fluidic interface between the bathtub segments.

12. The multi-piece bathtub of claim 11, wherein the gasket is integrated with at least one of the ribs and receiving trench.

13. A children's bathtub comprising:

at least two independent components adapted to be assembled together to provide a first predetermined sealed bathing area and thereafter be disassembled into independent components and reassembled together to provide a second predetermined sealed bathing area having dimensions differing from the first sealed bathing area, where each predetermined sealed bathing area provides a sealed cavity adapted to be occupied by a liquid;

wherein a first component of the at least two independent components includes a rib and a second component of the at least two independent components includes a first trench and a second trench; and wherein the first predetermined sealed bathing area is provided when the rib is assembled into the first trench and the second predetermined sealed bathing area is provided when the rib is assembled into the second trench.

14. The children's bathtub of claim 13, wherein:

the first component of the at least two components comprises a floor bounded by a first U-shaped raised wall adjacent to a first flange;

the second component of the at least two components comprises a floor bounded by a second U-shaped raised wall adjacent to a second flange; and at least a portion of the first component is adapted to overlap at least a portion of the second component to provide at least one predetermined sealed bathing area.

15. The children's bathtub of claim 13, further comprising a valve associated with at least one of the independent components and enabling a liquid to exit from at least one of the first and second sealed bathing areas.

16. The children's bathtub of claim 13, further comprising a platform mounted to and supporting the two independent components when the two independent components are assembled together.

17. A method of assembling a children's bathtub, the method comprising:

providing a children's bathtub including a first bathtub segment and a second bathtub segment, the first bathtub segment and the second bathtub segment adapted to be coupled together to provide a plurality of predefined sealed bathing areas;

aligning a sealing surface of the first bathtub segment with a corresponding surface of the second bathtub segment by positioning the sealing surface vertically in line with but not engaged with the corresponding surface, thereby horizontally overlapping a portion of the first bathtub segment over a portion of the second bathtub segment; and vertically repositioning the first bathtub segment to releasably couple with the second bathtub segment by translating the first bathtub segment relative to the second bathtub segment to engage the sealing surface with the corresponding surface to provide a sealed fluidic interface between the first bathtub segment and the second bathtub segment to provide one of the plurality of predefined seated bathing areas;

wherein the second bathtub segment includes a plurality of corresponding surfaces, each of the corresponding surfaces adapted to engage the sealing surface to provide a respective one of the plurality of predefined sealed bathing areas.

18. The method of claim 17, wherein the vertically repositioning act includes the act of compressing the first bathtub segment against the second bathtub segment to provide the seated fluidic interface between the first bathtub segment and the second bathtub segment.

19. The method of claim 17, wherein the first bathtub segment includes multiple sealing surfaces.

20. The method of claim 17, wherein the bathtub includes at least one gasket adapted to interface with the sealing surface of the first bathtub segment to provide the sealed fluidic interface.

* * * * *